United States Patent [19]

Raasch et al.

[11] 4,102,506

[45] Jul. 25, 1978

[54] DEVICE FOR CONTROLLING THE CONTACT PRESSURE OF A TEXTILE COIL ON A SUPPORT OR DRIVING CYLINDER

[75] Inventors: Hans Raasch; Hans Grecksch, both of Mönchen-Gladbach, Germany

[73] Assignee: W. Schlafhorst & Co., Mönchen Gladbach, Germany

[21] Appl. No.: 680,299

[22] Filed: Apr. 26, 1976

[30] Foreign Application Priority Data

Apr. 26, 1975 [DE] Fed. Rep. of Germany ..... 2518646

[51] Int. Cl.[2] ..... B65H 54/42

[52] U.S. Cl. ..... 242/18 DD; 242/34; 242/65

[58] Field of Search ..... 242/18 B, 18 DD, 34, 242/46, 65, 192

[56] References Cited

U.S. PATENT DOCUMENTS

| | | | |
|---|---|---|---|
| 1,257,182 | 2/1918 | Bradley | 242/46 |
| 1,655,155 | 1/1928 | McKean | 242/18 DD |
| 2,150,951 | 3/1939 | Toole et al. | 242/18 DD |
| 2,743,061 | 4/1956 | Kingsbury | 242/18 DD |
| 3,991,950 | 11/1976 | Tashiro et al. | 242/18 DD |

*Primary Examiner*—Richard C. Queisser
*Assistant Examiner*—Charles Gorenstein
*Attorney, Agent, or Firm*—Herbert L. Lerner

[57] ABSTRACT

Device for controlling the contact pressure of a textile coil on a support or drive cylinder includes articulatingly suspended coil holder means for rotatably supporting the coil over the cylinder, a spring-loaded toggle-joint assembly being movable in a given plane into positions thereof wherein it is partly and fully extended, the toggle-joint assembly including a lever articulatingly connected to the coil holder means, and means for adjusting in the given plane the direction in which the toggle-joint assembly extends in the fully extended position thereof.

8 Claims, 3 Drawing Figures

DEVICE FOR CONTROLLING THE CONTACT PRESSURE OF A TEXTILE COIL ON A SUPPORT OR DRIVING CYLINDER

BACKGROUND OF THE INVENTION

1. Field of the Invention

The invention relates to device for controlling the contact pressure of a textile coil on a support or driving cylinder, wherein the coil is supported by an articulatingly suspended coil holder having a lever fastened thereon and forming part of a spring-loaded toggle-joint assembly.

2. Description of the Prior Art

In various machines for the production, processing or testing of yarns or threads, such as winding machines, spinning machines or texturizing machines, for example, the thread or yarn is wound on a universal or cross-wound coil or cheese winding device. The coil or bobbin is braced or supported by a conical or cylindrical roller which often also assumes the task of driving the coil or bobbin.

The contact area between the roller or cylinder and the textile coil or bobbin is subjected to the application of forces which depend upon the volume and weight of the bobbin or coil, the weight of the coil holder, and the angular position of the coil holder relative to the cylinder or roller. The weight of the coil increases as the square of the coil diameter. This results in an undesirable increase in the contact pressure between the coil and the cylinder or roller as the diameter of the textile coil increases.

Previously known devices have provided the coil holder with a lever which is part of a spring-loaded toggle-joint assembly. In the fully extended or stretched position of the toggle joint, the spring exerts no torque on the coil holder when the coil diameter is not too small. If the coil diameter is small, however, the toggle joint is deflected to one side so that the spring exerts a torque on the coil holder which acts in a direction tending to increase the contact pressure. With increasing coil diameter, this torque becomes smaller and finally zero, whereupon the toggle joint is deflected to the other side so that the spring then exerts a torque which acts on the coil holder in a direction tending toward decreasing the contact pressure, the last mentioned torque becoming larger with increasing coil diameter.

Through a suitable choice of the joint configuration, the joint dimensions and the spring characteristic, a resulting contact pressure can be attained which is approximately constant or becomes smaller with increasing coil diameter. It is difficult, however, to vary the contact pressure exactly in accordance with a given build-up or formation of the textile coil being wound.

Since the contact pressure has a great influence or effect upon the coil density and the firmness or compactness of the coil, attempts have been made to adapt or accommodate the contact pressure to the further processing of the textile coil by changing the weight of the coil holder or the force of the spring. Dyeing coils are thus made with a contact pressure that is light and as constant as possible. On the other hand, coils from which good thread withdrawal characteristics are expected, are produced with a very high contact pressure at the start of the winding operation and with decreasing contact pressure as the coil diameter increases, the decrease in the contact pressure preventing the windings from bulging or billowing out at the end faces of the textile coil.

Heretofore known devices of this general type and their limited possibilities of adjustment have not been able to meet these different requirements to the demanded extent and with the desired characteristics.

SUMMARY OF THE INVENTION

It is therefore an object of the invention to avoid the foregoing disadvantages of the heretofore known devices of this general type and to match or accommodate the magnitude and characteristic of the contact pressure to the respective desired textile coil build-up or formation with one and the same control device.

With the foregoing and other objects in view, there is provided, in accordance with the invention, a device for controlling the contact pressure of a textile coil on a support or drive cylinder, comprising articulatingly suspended coil holder means for rotatably supporting the coil over the cylinder; a spring-loaded toggle-joint assembly being movable in a given plane into positions thereof wherein it is partly and fully extended, the toggle-joint assembly including a lever articulatingly connected to the coil holder means; and means for adjusting in the given plane the direction in which the toggle-joint assembly extends in the fully extended position thereof. In this regard, preferably the one foot or base of the toggle-joint assembly is shifted or adjusted. Accordingly, it can move to one side from the theretofore outstretched or fully extended position of the toggle joint, while simultaneously, however, moving toward or away from the other foot or base of the assembly.

In accordance with another feature of the invention, the toggle-joint assembly also includes spring means for loading the assembly; the adjusting means, when adjusting the direction in which the toggle-joint assembly extends in the fully extended position thereof, simultaneously adjusting the spring force of the spring means.

In accordance with further features of the invention, the device of the invention includes means for actuating the adjusting means, and the actuating means comprise a device cooperable with a multiplicity of the toggle-joint assemblies for simultaneously actuating the respective adjusting means thereof.

In accordance with an added feature of the invention, the toggle-joint assembly also includes a rod articulatingly connected to the lever which is, in turn, articulatingly connected to the coil holder means.

In accordance with an additional feature of the invention, the adjusting means comprises a bell crank lever having one lever end thereof forming a foot of the toggle-joint assembly, and having an adjusting element at the other lever end thereof.

In accordance with yet another feature of the invention, the adjusting element is formed of a cambered roller, which cooperates especially advantageously with the actuating device which simultaneously actuates the multiplicity of adjusting means.

In accordance with a concomitant feature of the invention, the actuating device for simultaneously actuating the multiplicity of adjusting means comprises a longitudinally shiftable bar having drawing wedge members secured thereto and engageable with the cambered rollers of the respective adjusting means. With such a construction, deformations due to bending, tensile or compressive stresses do not become noticeably disturbing if a multiplicity of adjusting devices is actuated in common.

It should be noted as particularly advantageous that, by means of the invention, a contact pressure of selective magnitude is infinitely i.e. steplessly, adjustable at will to decrease, remain constant or increase with increasing coil diameter, the contact pressure, as desired, being approximately a linear function of the coil diameter.

Other features which are considered as characteristic for the invention are set forth in the appended claims.

Although the invention is illustrated and described herein as embodied in device for controlling the contact pressure of a textile coil on a support or driving cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
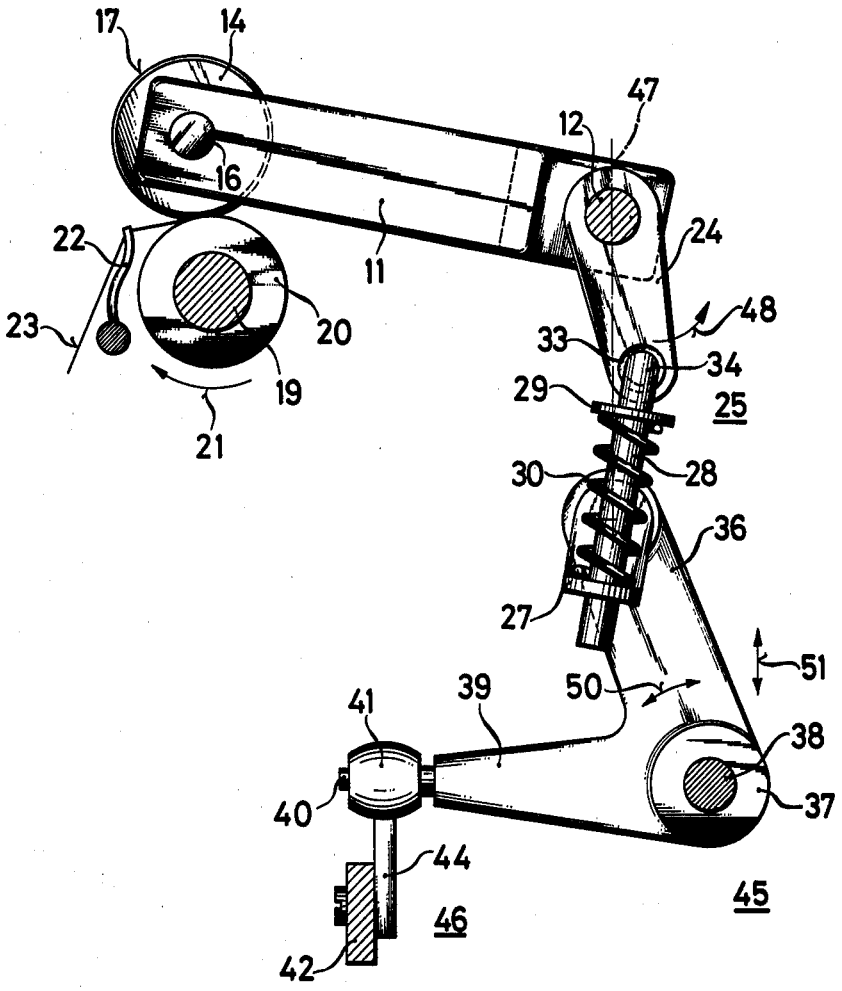
FIG. 1 is a diagrammatic side elevational view partly in section of part of a winding station of a textile machine, including the device for controlling the contact pressure of a textile coil on a support or drive cylinder, according to the invention, in a phase thereof at the beginning of the winding process.

Referring now to the figures of the drawing, there is shown therein a winding station having a coil or bobbin holder 11 connected to a shaft 12 that is rotatably mounted in non-illustrated stationary bearings.

The coil holder 11 carries two coil core or tube plates or seats 13 and 14, which are rotatably mounted in the coil holder 11 on shaft 15 and 16. The coil core plates 13 and 14 hold a coil core or tube 17, on which a textile coil or bobbin 18 is wound. In this regard, a drive roller or cylinder 20 is set into rotation in direction of the arrow 21 by means of a shaft 19 having stationary bearings. At the beginning of the winding operation, the coil core or tube 17 and, subsequently, the textile coil 18, are driven by friction. A reciprocating thread guide 22 provides for the winding up of the thread 23 in crossed layers.

The coil holder 11 is connected through the shaft 12 to a lever 24, which is part of a spring-loaded toggle-joint assembly 25, which also includes a base or foot joint pin 26, a foot guide angle iron or bracket 27, a plunger or push rod 28 with pressure plate 29, and a compression spring so. A bent end 31 of the push rod 28 is rotatably mounted in a bore formed in the lever 24 and is secured by discs or washers 32 and 33. The middle joint 34 of the toggle-joint assembly 25 is formed thereby. The lower end of a push rod 28, as viewed in all of the figures, extends through a bore formed in the guide angle iron 27. The guide angle iron 27 per se is firmly connected to the foot joint pin 26. The compression spring 30, which is slipped over the push rod 28, is held, at one end thereof, with a pre-tensioning force against the pressure plate 29 and, at the other end thereof, against the guide angle iron or bracket 27.

The base or foot joint pin 26, secured by a disc or washer 35, is rotatably mounted in a bore formed in a lever end 36 of a bell crank or angle lever 37.

The bell crank lever 37 is, in turn, mounted so as to pivot about a stationary shaft 38. A spherical or cambered roller 41, which serves as an adjusting element, is provided on a shaft 40 at the other lever end 39 of the bell crank lever 37.

A bar 42 is shiftable in non-illustrated stationary guides in direction of a double-headed arrow 43. The bar 42 extends over a multiplicity of winding stations and has a corresponding multiplicity of drawing wedges, of which only the drawing wedge 44 belonging to the illustrated winding station is visible. The inclined surface of the wedge 44 serves as a guide for the roller 41, to permit adjustment of the position of angle or bell crank lever 37.

The parts 36 to 41 constitute an adjusting device 45 for the toggle-joint assembly 25, and the parts 42 and 44 form an actuating device 46 for the adjusting device 45.

The adjusting device 45 has assumed and been arrested in a given fixed position. As shown in FIG. 1, at the start of the winding operation, the middle joint 34 of the toggle-joint assembly 25 has been deflected to the right-hand side of the center line 47, which respresents the fully extended position thereof. The pre-stressed or biased compression spring 30 exerts a torque on the lever 24 in direction of the arrow 48, which consequently produces a torque on the coil holder 11 exerted in a direction tending to increase the contact pressure of the coil core 17 upon the drive cylinder 20.

With increasing fullness of the wound coil 18, the torque produced by the compression spring 30 becomes smaller, attains a value of zero in the fully extended position when parts 24 and 28 lie along line 47, and again beomes increasingly larger with further increasing fullness or extent of winding of the wound coil 18. In the latter phase of winding, however, the direction of application of the torque is opposite, as shown by the arrow 49 in FIG. 2, than in the initial phase thereof shown in FIG. 1. Thus, the torque acts in opposite senses on the lever 24 during the winding phases shown. As can be seen from FIG. 2, the middle joint 34 is then disposed to the left-hand side of the center line 47 which represents the fully extended position of the toggle-joint assembly 25.

Figure 2:
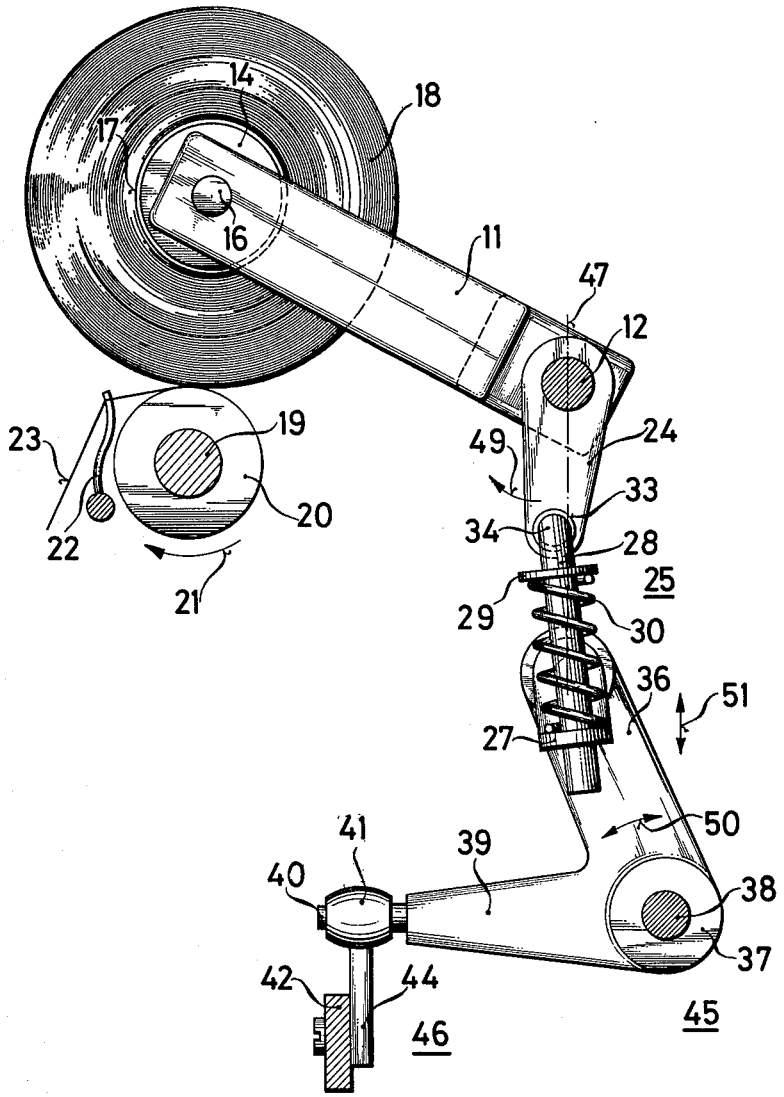
FIG. 2 is a view of FIG. 1 showing the device in a phase thereof after the diameter of the wound textile coil has considerably increased.
Figure 3:
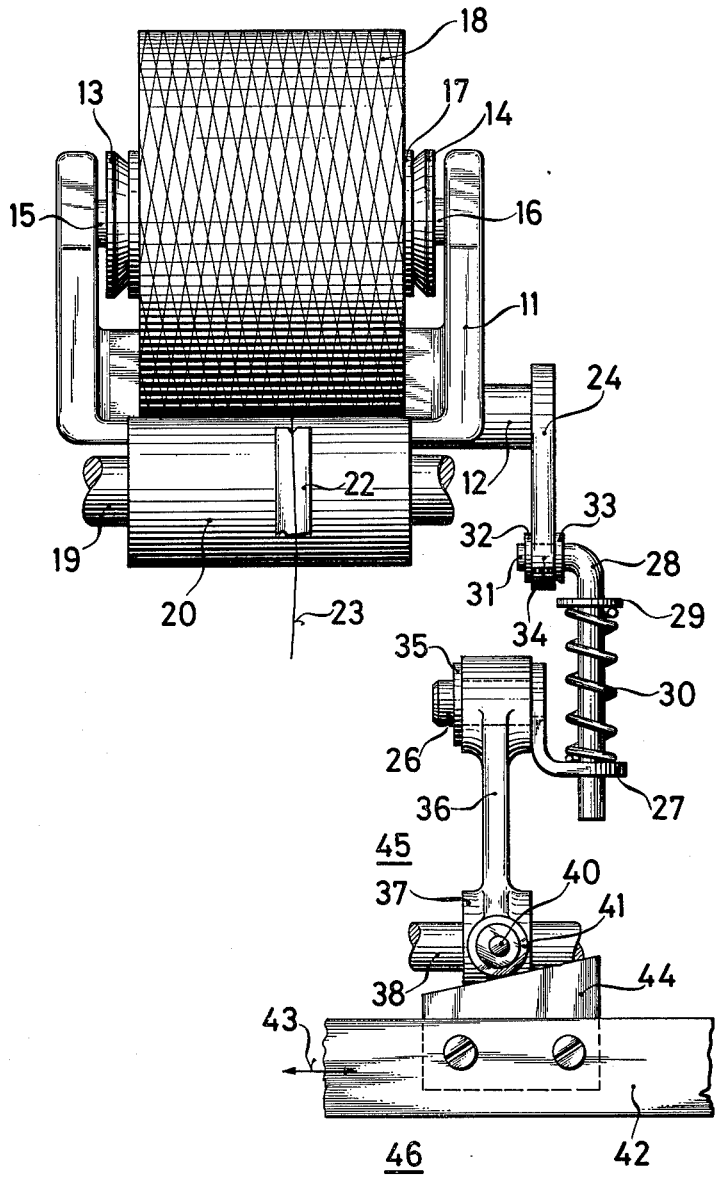
FIG. 3 is a front elevational view of FIG. 2 i.e. a view from the right-hand side thereof, showing the device in the same position.

By appropriately shifting the bar 42, the foot or base 27 of the toggle-joint assembly 25, wherein the base or foot joint pin 26 is mounted, can be adjusted in the plane of movement of the joint in such a manner that the fully extended position of the toggle-joint assembly 25 either exists at a desired wound coil diameter, or has already been extended at the start of the winding, or will not even be attained at all during the winding process. In the first case, the sense of the direction of application of the torque produced by the compression spring 30 changes during the winding process. In the second case, the torque is positive during the entire winding operation i.e. clockwise, as shown in FIG. 2, and in the third case, it is negative during the entire winding operation i.e. counterclockwise, as shown in FIG. 1. with each adjustment of the bell crank or angle lever 37, the spring force of the compression spring 30 is simultaneously varied, so that the desired characteristic of the contact pressure is maintained within narrow limits.

In the embodiment of the invention illustrated and described herein, the lever end 36 of the bell crank or angle lever 37 is pivotable in direction of the double-headed arrow 50. In a somewhat modified embodiment, it is possible to effect another position change, for example, in the direction represented by the double-headed arrow 51. The pre-stressing or biasing of the compression spring 30 could be variable additionally for adjustment purposes, to which end an adjusting or set screw, for example, may be utilized. Furthermore, the preloading or prebiasing of the toggle-joint assembly 25 could also be effected by a tension spring instead of a compression spring.

There are claimed:

1. Device for controlling the contact pressure of a textile coil on a support or drive cylinder, comprising articulatingly suspended coil holder means for rotatably supporting the coil over the cylinder, a toggle-joint assembly being movable in a given plane into positions thereof wherein it is partly and fully extended, said toggle-joint assembly including a lever articulatingly connected to said coil holder means and a foot member operatively connected to said lever, said foot member having an end; and means for adjusting in said given plane the direction in which said toggle-joint assembly extends in said fully extended position thereof, said adjusting means being located at said foot end of said toggle-joint assembly.

2. Device according to claim 1 wherein said toggle-joint assembly also includes spring means for loading said assembly; said adjusting means also constitutes means for adjusting the spring force of said spring means.

3. Device for controlling the contact pressure of a textile coil on a support or drive cylinder, comprising articulatingly suspended coil holder means for rotatably supporting the coil over the cylinder, a spring-loaded toggle-joint assembly being movable in a given plane into positions thereof wherein it is partly and fully extended, said toggle-joint assembly including a lever articulatingly connected to said coil holder means; means for adjusting in said given plane the direction in which said toggle-joint assembly extends in said fully extended position thereof, and means for actuating said adjusting means.

4. Device according to claim 3 wherein said actuating means comprises a device cooperable with a multiplicity of said toggle-joint assemblies for simultaneously actuating the respective adjusting means thereof.

5. Device according to claim 1 wherein said toggle-joint assembly also includes a rod articulatingly connected to said lever.

6. Device for controlling the contact pressure of a textile coil on a support or drive cylinder, comprising articulatingly suspended coil holder means for rotatably supporting the coil over the cylinder, a spring-loaded toggle-joint assembly being movable in a given plane into positions thereof wherein it is partly and fully extended, said toggle-joint assembly including a lever articulatingly connected to said coil holder means; and means for adjusting in said givven plane the direction in which said toggle-joint assembly extends in said fully extended position thereof, said adjusting means comprising a bell crank lever having one lever end thereof carrying a foot member of said toggle-joint assembly, and having an adjusting element at the other lever end thereof.

7. device according to claim 6 wherein said adjusting element is formed of a cambered roller.

8. Device according to claim 7 including means for actuating said adjusting means, said actuating means comprising a device cooperable with a multiplicity of said toggle-joint assemblies for simultaneously actuating the respective adjusting means thereof, said device for simultaneously actuating the mutliplicity of adjusting means comprising a longitudinally shiftable bar having drawing wedge members secured thereto and engageable with the cambered rollers of the respective adjusting means.

* * * * *